US006613112B1

(12) United States Patent
Taniguchi

(10) Patent No.: US 6,613,112 B1
(45) Date of Patent: Sep. 2, 2003

(54) RECHARGEABLE LPG CONTAINER FOR PORTABLE GAS COMBUSTOR

(75) Inventor: Hitoshi Taniguchi, Tokyo (JP)

(73) Assignee: Iwatani International Corporation, Osaka (JP)

( * ) Notice: Subject to any disclaimer, the term of this patent is extended or adjusted under 35 U.S.C. 154(b) by 0 days.

(21) Appl. No.: 09/508,076

(22) PCT Filed: Aug. 25, 1999

(86) PCT No.: PCT/JP99/04600

§ 371 (c)(1),
(2), (4) Date: Mar. 13, 2000

(87) PCT Pub. No.: WO00/26575

PCT Pub. Date: May 11, 2000

(30) Foreign Application Priority Data

Nov. 4, 1998 (JP) ..... H10-313089

(51) Int. Cl.[7] ..... F17B 1/00

(52) U.S. Cl. ..... 48/174; 141/18; 141/383; 48/175; 53/403; 220/581; 220/582

(58) Field of Search ..... 48/174, 175; 53/403, 53/405, 406, 77, 79, 84, 85; 220/560.04, 582, 581, 202, 203.01, 240; 141/18, 383

(56) References Cited

U.S. PATENT DOCUMENTS 5,027,871 A * 7/1991 Guenther ..... 141/198
5,037,063 A * 8/1991 Kerger et al. ..... 251/149.8
5,150,741 A * 9/1992 Valy et al. ..... 141/18

FOREIGN PATENT DOCUMENTS

FR 2038749 A * 1/1971
JP 53049584 A * 6/1978
JP 53023252 A * 4/1979
JP 63172095 A * 7/1988

* cited by examiner

*Primary Examiner*—Jerry D. Johnson
*Assistant Examiner*—Basia Ridley
(74) *Attorney, Agent, or Firm*—Bacon & Thomas, PLLC

(57) ABSTRACT

LPG storing cylinder (1) has a top portion fixed to a valve block (2) provided with a through hole (4) for attaching a gas take-out nozzle (3). The gas take-out nozzle (3) is attached to the through hole (4) as it is urged with an urging spring (6) for valve closing. A gas take-out passage (7) within the gas take-out nozzle (3) communicates with the nozzle attaching through hole (4) by a window hole (8). A sealing ring (10) is fitted into a portion where the window hole (8) is formed to shut off a communication between an interior area of the gas storing cylinder (1) and the gas take-out passage (7). A guide pipe (12) to communicate the interior area of the cylinder with a valve chamber (5) projects from an inner end wall of the valve block (2) into the interior area of the LPG storing cylinder (1).

2 Claims, 3 Drawing Sheets

RECHARGEABLE LPG CONTAINER FOR PORTABLE GAS COMBUSTOR

TECHNICAL FIELD

The present invention relates to an LP gas storing cylinder used for a fuel source of a portable gas burner and more particularly to an LP gas storing cylinder adapted so as to be able to be recharged with LP gas.

EARLIER TECHNOLOGY

There is a conventional LP gas storing cylinder which is used by being attached to a portable gas burner instrument. This conventional cylinder comprises a main body having a top portion to which a gas take-out nozzle constituting part of a gas shut-off valve is attached so as to be able to advance and retreat. When the LP gas storing cylinder is attached to the gas burner instrument, the gas take-out nozzle is pushed into the cylinder to open the gas shut-off valve. Conversely, when it is removed from the gas burner instrument, the gas take-out nozzle advances to close the gas shut-off valve.

Generally, the gas storing cylinder of this type is charged with LP gas in a factory and thereafter is circulated in the market. The gas shut-off valve is formed from one gas passage. Therefore, a trial to recharge the LP gas has resulted in vain unless a compressor is used or the gas storing cylinder has its temperature lowered to reduce its inner pressure because gas residual in the cylinder is going to be pressurized as the LP gas is recharged. For this reason, generally the LP gas cylinder was disposed after the gas contained therein had been used and therefore could be employed only once. However, the disposed gas storing cylinder still keeps so sufficient a strength that it costs a huge amount of expense to deal with the disposed gas storing cylinders. Therefore, economical loss resulted from disposing the gas storing cylinders as well as from dealing with the disposed gas storing cylinders.

In an attempt to solve the above economical disadvantage, the present invention aims at providing an LP gas storing cylinder able to be recharged with LP gas easily even in a house.

DISCLOSURE OF THE INVENTION

The present invention is characterized in that:

an LP gas storing cylinder has a top portion fixed to a valve block provided with a through hole for attaching a gas take-out nozzle, the nozzle attaching through hole having a halfway portion provided with a valve chamber, a gas take-out nozzle being attached to the nozzle attaching through hole as urged with an urging spring for valve closing in a direction where it advances, the gas take-out nozzle having an interior area provided with a gas take-out passage so as not to pass through the nozzle, the nozzle attaching through hole communicating with the gas take-out passage by a window hole formed through a wall of the gas take-out nozzle, a sealing ring being fitted into a portion where the window hole is formed;

the sealing ring comes into contact with a front end wall surface of the valve chamber to thereby shut off a communication between an interior area of the LP gas cylinder and the gas take-out passage when the gas take-out nozzle has advanced, and on the other hand, it comes to contact with an inner end wall surface of the valve chamber to thereby communicate the interior area of the LP gas cylinder with the gas take-out passage when the gas take-out nozzle has retreated; and a guide pipe to communicate the interior area of the LP gas cylinder with the valve chamber projects from an inner end wall of the valve block into the interior area of the cylinder.

The present invention adapts the valve chamber formed in the valve block and the interior area of the LP gas storing cylinder so that they can communicate with each other by the nozzle attaching through hole and the guide pipe. The gas take-out nozzle attached to the nozzle attaching through hole has an interior area formed with the gas take-out passage so as not to pass through the nozzle. This passage communicates with the nozzle attaching through hole. When the gas take-out nozzle has been pushed in, the LP gas storing cylinder has its interior area communicated with its exterior area through the gas take-out passage. Consequently, when this LP gas storing cylinder is connected to a burner instrument, the gas take-out nozzle is pushed in to supply LP gas within the LP gas storing cylinder to the burner instrument.

On the other hand, when the LP gas within the LP gas storing cylinder has decreased in amount, the current LP gas storing cylinder has the gas take-out nozzle attached to a gas take-out nozzle of a supplementing LP gas storing cylinder in butting relationship therewith, instead of the burner instrument. Then the gas take-out nozzle of the current LP gas storing cylinder is pushed in to communicate the gas take-out passage formed in the gas take-out nozzle with the interior area of the cylinder main body. As a result, the LP gas contained in the supplementing LP gas storing cylinder flows down into the current LP gas storing cylinder through the gas take-out passage to thereby be recharged. At this time, gaseous component within the current LP gas storing cylinder is pushed up by flowed-in liquid component to be discharged out of the current LP gas cylinder through the guide pipe, the valve chamber, and a space between an outer peripheral surface of the gas take-out nozzle and an inner peripheral surface of the nozzle attaching through hole.

And the present invention projects the guide pipe from the valve block into the interior area of the cylinder. Owing to this arrangement, the recharged LP gas is poured into the current LP gas storing cylinder in a predetermined amount and when its liquid level reaches a lower end of the guide pipe, the liquid component is pushed out of the guide pipe by an inner pressure of the current LP gas storing cylinder to result in being able to appreciate the predetermined amount of the LP gas has been recharged.

MOST PREFERRED EMBODIMENT OF THE INVENTION

Figure 1:
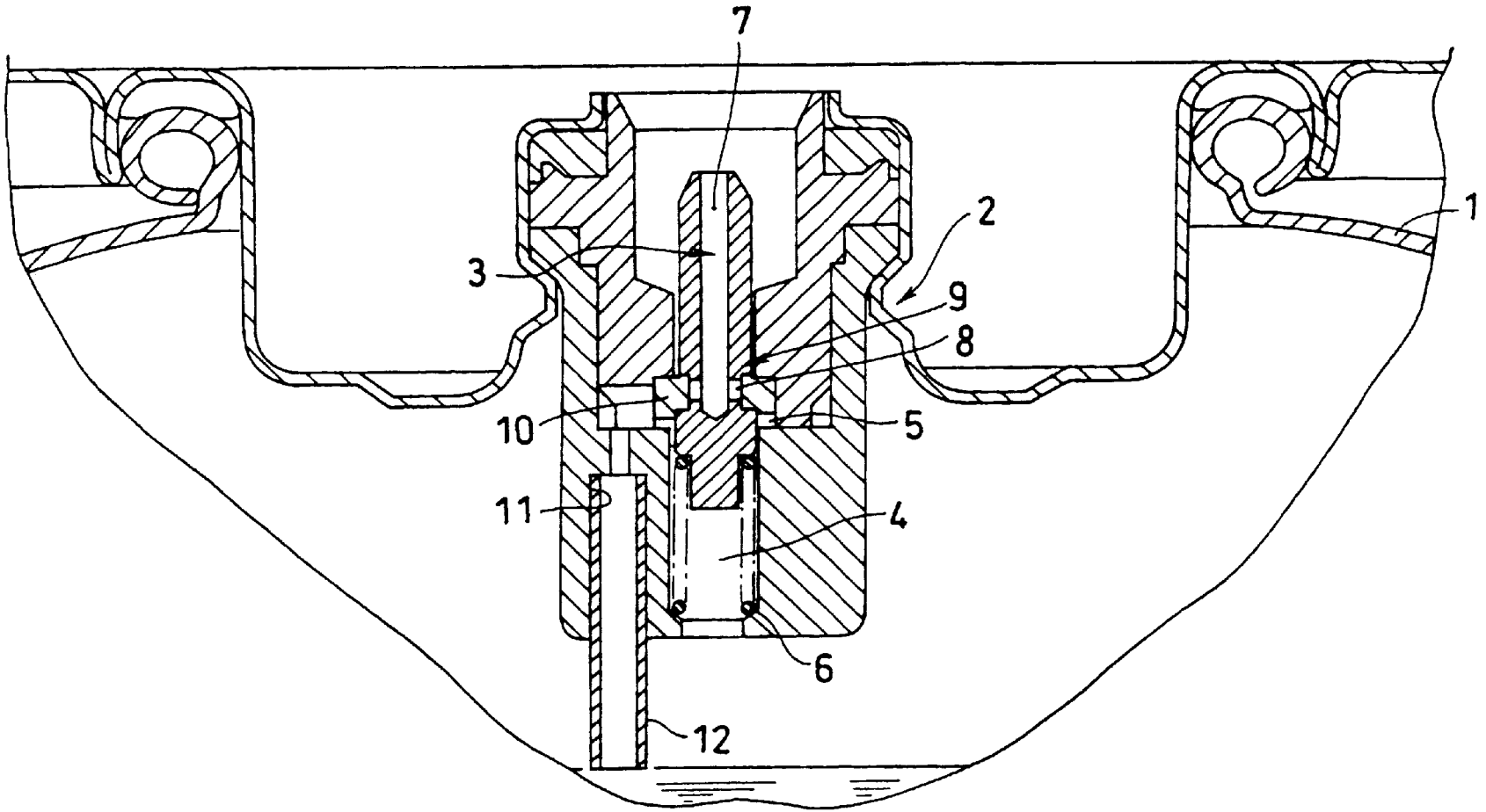
FIG. 1 is an enlarged sectional view of an essential part of a preferable LP gas cylinder according to the present invention when it is closed.

The drawings show an embodiment of an LP gas storing cylinder to which the present invention is applied. In FIG. 1 numeral 1 designates an LP gas storing cylinder formed like substantially a dome as a whole. Numeral 2 indicates a valve block fixedly attached to a ceiling surface of the LP gas storing cylinder 1.

The valve block 2 is vertically provided with a through hole 4 for attaching a gas take-out nozzle 3. The through hole 4 is diametrically enlarged at its midway portion to provide a valve chamber 5. A gas take-out nozzle 3 is attached to the through hole 4 so as to be able to advance and retreat. The gas take-out nozzle 3 is urged with an urging spring 6 for valve closing so as to advance outwards (upwards) of the cylinder.

The gas take-out nozzle 3 has an upper end provided with a gas take-out passage 7 extending therefrom so as not to pass through the nozzle 3. A window hole 8 is provided through a nozzle wall at an inner end of the gas take-out passage 7, thereby communicating the gas take-out passage 7 with the nozzle attaching through hole 4. The gas take-out nozzle 3 has an outer peripheral surface provided with a peripheral groove-like recess 9 at a portion through which the window hole 8 is provided. A sealing ring 10 is fitted into the recess 9 to seal the window hole 8.

A hole 11 for inserting and fitting a guide pipe 12 is provided from an inner end surface (lower end surface) of the valve block 2 toward the valve chamber 5 in parallel with the through hole 4. The guide pipe 12 is inserted into this hole 11 in fitting relationship and fixed thereto so that it projects into an interior area of the cylinder. The guide pipe 12 has a lower end adjusted to position at a liquid level when a predetermined amount of the LP gas has been stored in the cylinder.

Figure 2:
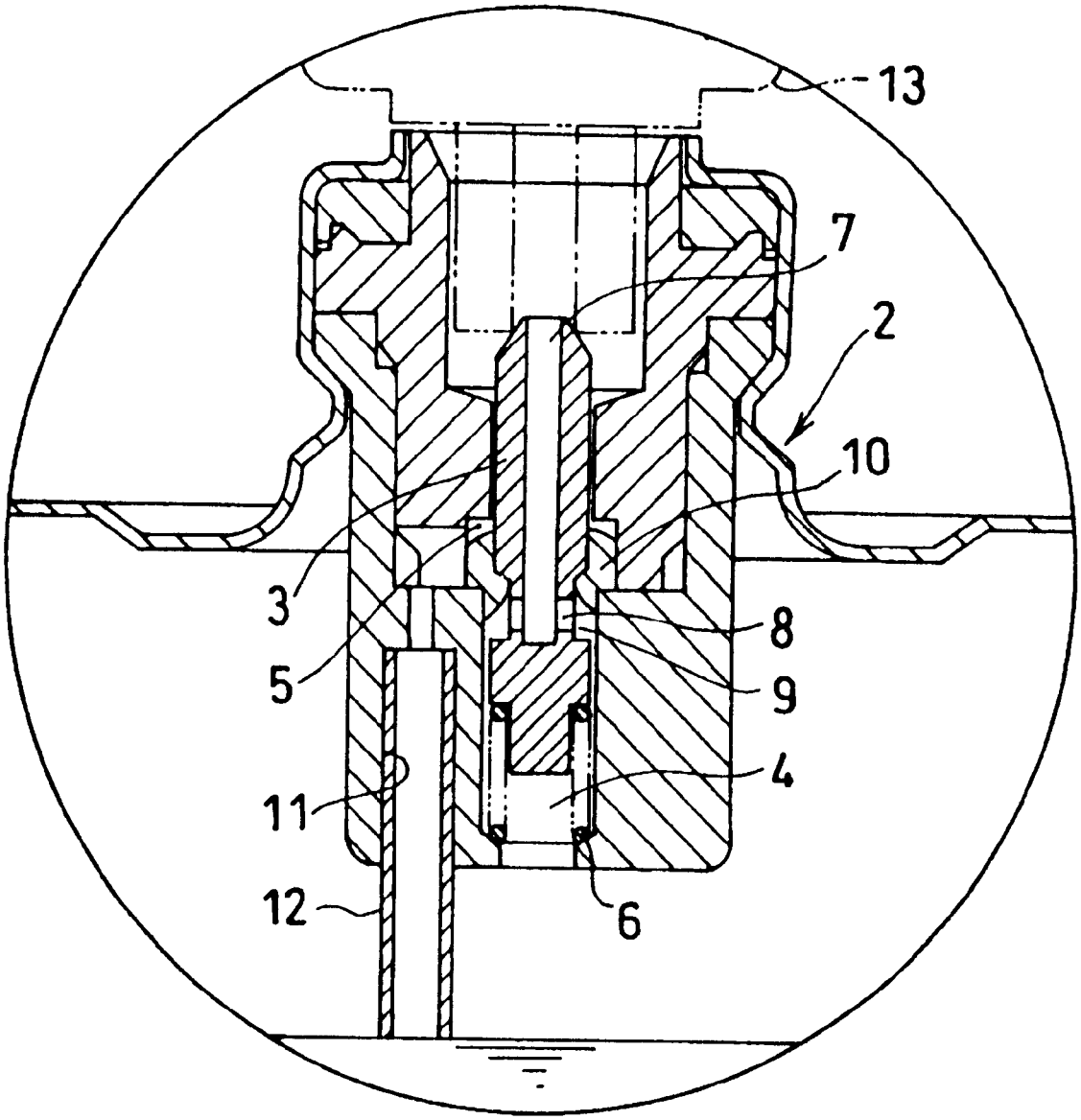
FIG. 2 is an enlarged sectional view of the essential part when the gas cylinder is opened.

In the event the LP gas storing cylinder constructed as above is connected to a burner instrument (not shown), as shown in FIG. 2 the gas take-out nozzle 3 retreats against a resilient force of the urging spring 6 to bring the sealing ring 10 fitted into the gas take-out nozzle 3, into contact with a peripheral edge of an opening of the nozzle attaching through hole 4 provided by opening a lower end surface of the valve chamber 5 and leave it there. This enables the window hole 8 formed through the gas take-out nozzle 3 to communicate the gas take-out passage 7 within the nozzle 3 with the nozzle attaching through hole 4. Then gaseous component of the LP gas stored in the cylinder passes through a space between an inner peripheral surface of the nozzle attaching through hole 4 and an outer peripheral surface of the gas take-out nozzle 3 both positioned below the window hole 8, the window hole 8 and the gas take-out passage 7 to thereby supply fuel gas into the burner instrument.

At this time, the valve chamber 5 communicates with a space between the inner peripheral surface of the nozzle attaching through hole 4 and the outer peripheral surface of the gas take-out nozzle 3 both positioned above the window hole 8 and is in communication with an interior area of the cylinder through the guide pipe 12. Therefore, the gaseous component of the LP gas within the cylinder tries to leak out through the guide pipe 12, the valve chamber 5, and the space between the inner peripheral surface of the nozzle attaching through hole 4 and the outer peripheral surface of the gas take-out nozzle 3 both positioned above the window hole 8. However, on connecting the cylinder to the burner instrument, the burner instrument is coated on an outer periphery of the valve block 2 and a gasket or the like seals a space therebetween. This arrangement prevents the gas from leaking out of the cylinder through this route.

Figure 3:
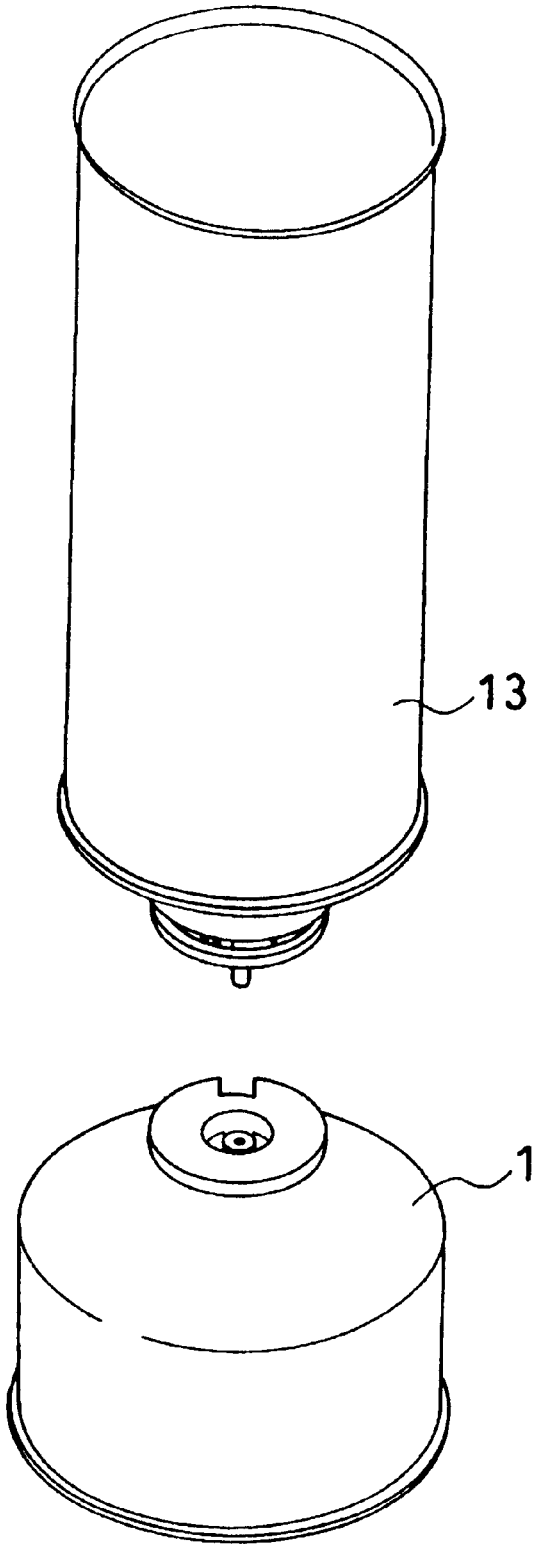
FIG. 3 is a perspective view showing a state where LP gas is recharged.

When the LP gas is recharged into the LP gas storing cylinder 1, a supplementing LP gas storing cylinder 13 shown in FIG. 3 has a nozzle portion brought into contact with a front end of the gas take-out nozzle 3 and pushed in. Then as in the case of connecting it to the burner instrument, the gas take-out nozzle 3 retreats to communicate the gas take-out passage 7 with the interior area of the cylinder main body. At this time, the space between the inner peripheral surface of the nozzle attaching through hole 4 and the outer peripheral surface of the gas take-out nozzle 3 both positioned above the window hole 8 is opened to the exterior area of the cylinder. Accordingly, the gas take-out passage 7 within the gas take-out nozzle 3 communicates with a passage within the nozzle portion of the supplementing LP gas storing cylinder 13 to thereby transfer the LP gas within the supplementing LP gas storing cylinder 13 to the receiving LP gas storing cylinder 1 owing to differential pressure between a gas pressure of the supplementing LP gas storing cylinder 13 and an inner pressure of the receiving LP gas storing cylinder 1.

At this time, the gaseous component within the receiving LP gas storing cylinder 1 is taken out of the cylinder through the guide pipe 12, the valve chamber 5, and the space between the inner peripheral surface of the nozzle attaching through hole 4 and the outer peripheral surface of the gas take-out nozzle 3 both positioned above the window hole 8. As a result, the LP gas within the supplementing LP gas storing cylinder 13 is smoothly transferred into the receiving LP gas storing cylinder 1.

The current LP gas storing cylinder is usable to keep foods and beverages hot in the Viking style food service which conventionally employed an alcohol lamp or a portable fuel in hotels, Japanese inns and banquet rooms as well as to provide a small fire source for foods and beverages served per person. And the present invention makes it possible to utilize an LP gas storing cylinder which is generally employed for a gas cooking stove of such a type as accommodating a gas cylinder, or the like as for the supplementing LP gas storing cylinder 13.

What is claimed is:

1. A rechargeable LP gas storing cylinder for a portable gas burner, which is attached to the portable gas burner when it is used and has a top portion to which a gas take-out nozzle (3) is attached so as to be able to advance and retreat, the gas take-out nozzle (3) constituting part of a gas shut-off valve, wherein the top portion of the LP gas storing cylinder (1) is fixed to a valve block (2) provided with a through hole (4) for attaching a gas take-out nozzle (3), the nozzle attaching through hole (4) having a halfway portion provided with a valve chamber (5), the gas take-out nozzle (3) being attached to the through hole 4 as urged with an urging spring (6) for valve closing in a direction where it advances, a gas take-out passage (7) being formed within the gas take-out nozzle (3) so as not to pass through the nozzle (3), the nozzle attaching through hole (4) communicating with the gas take-out passage (7) by a window hole (8) provided through a wall of the gas take-out nozzle (3), a sealing ring (10) being fitted into a portion where the window hole (8) is formed, the sealing ring (10) being brought into contact with a front end wall surface of the valve chamber (5) to shut off a communication between an interior area of the gas storing cylinder (1) and the gas take-out passage (7) when the gas take-out nozzle (3) has advanced and being brought into contact with an inner end wall surface of the valve chamber (5) to thereby communicate the interior area of the LP gas storing cylinder (1) with the gas take-out passage (7) when the gas take-out nozzle (3) has retreated, a guide pipe (12) to communicate the interior area of the cylinder with the valve chamber (5) projecting from an inner end wall of the valve block (2) into the interior area of the LP gas storing cylinder (1).

2. The rechargeable LP gas storing cylinder for a portable gas burner as set forth in claim 1, wherein the guide pipe (12) has a projecting front end adapted to determine the highest liquid level within the cylinder.

* * * * *